United States Patent [19]

Howell

[11] 4,049,239

[45] Sept. 20, 1977

[54] DRILL SPRING TENSION LIMITING DEVICE FOR FLOATING DRILLING VESSELS

[75] Inventor: James D. Howell, Gretna, La.

[73] Assignee: Exxon Production Research Company, Houston, Tex.

[21] Appl. No.: 638,255

[22] Filed: Dec. 8, 1975

[51] Int. Cl.[2] ..... B66D 1/48

[52] U.S. Cl. ..... 254/172; 175/27; 188/313

[58] Field of Search ..... 254/172; 214/14; 175/21, 27, 5; 188/313, 318; 267/75

[56] References Cited

U.S. PATENT DOCUMENTS

| | | | |
|---|---|---|---|
| 1,855,897 | 4/1932 | Taylor | 188/313 |
| 2,016,755 | 10/1935 | Spracher | 188/313 |
| 2,763,466 | 9/1956 | Lehr et al. | 188/313 |
| 2,838,140 | 6/1958 | Rasmusson et al. | 188/313 |
| 3,117,773 | 1/1964 | Wallens et al. | 188/313 |
| 3,158,208 | 11/1964 | Kammerer | 175/5 |
| 3,511,476 | 5/1970 | Horton | 254/172 |

*Primary Examiner*—Robert J. Spar
*Assistant Examiner*—Kenneth Noland
*Attorney, Agent, or Firm*—William K. Guest; Salvatore J. Casamassima

[57] ABSTRACT

An apparatus for limiting the tension to which a suspended member can be subjected is disclosed. The apparatus responds to excessive tensile stress by increasing in length at a rate to keep such stress from exceeding a predetermined level. The present invention includes a closed cylinder with a piston disposed therein. Connected to the piston is a piston rod which extends through an opening in one end of the cylinder. The cylinder and piston rod are adapted to connect with a suspended member and a hoisting means. A bypass conduit connects the cylinder chambers by extending from one side of the piston to the other. In the conduit, there is a flow control regulator which actuates when the pressure on one side of the piston reaches a predetermined level, corresponding to a proportional tensile stress, permitting fluid to flow through the conduit in such a volume that the pressure on that side of the piston is maintained at the predetermined level.

6 Claims, 3 Drawing Figures

DRILL SPRING TENSION LIMITING DEVICE FOR FLOATING DRILLING VESSELS

BACKGROUND OF THE INVENTION

1. Field of the Invention

The present invention pertains to limiting the maximum tension in a string of drill pipe or other member suspended from a floating vessel and which may be subjected to stresses of magnitudes that could cause the pipe to yield or even fail.

2. Description of the Prior Art

As the demand for hydrocarbons has increased, the search for crude oil and natural gas has been extended further out into the sea. With increasing water depths, more and more drilling is conducted from floating vessels. A number of problems are encountered in floating drilling operations as a result of vessel motions caused by wind, waves and currents. Vertical movements of the vessel pose particularly severe problems. For most drilling operations, however, vessel heave is compensated for by the use of slip joints positioned in the suspended tubular members, permitting them to extend rather than become overstressed.

At times, drilling procedures must be performed which render the telescoping joints of little use in alleviating pipe stresses caused by vertical motion. For example, a number of operations require the drilling rig to pull upward on an apparatus or other load which is anchored to the sea floor. This may result from the apparatus being stuck, allowing no vertical movement, or restrained by design, allowing only limited vertical movement. When using the suspended pipe string to pull upward on such apparatus, all of the ship joints will, of course, be fully extended. In such a case, there is a significant risk that the suspended pipe string may be excessively stressed, especially if the floating vessel suddenly heaves upward due to wind or wave action. Not only could the excessive stress cause the suspended pipe string to yield or even fail, but it also could damage the subsea apparatus. Therefore, there exists a need for an apparatus that will limit the maximum tension which can be imposed on a suspended pipe string.

SUMMARY OF THE INVENTION

The present invention is directed to apparatus which alleviates the difficulties outlined above by limiting the amount of stress to which a suspended member can be subjected. The apparatus of the present invention is positioned in the pipe string and will function as any other span of pipe as long as the axial stress in the string is less than the maximum allowable stress preset in the apparatus. When the axial stress increases to the predetermined maximum, the apparatus of the invention begins to increase in axial length, preventing the stress in the pipe string from exceeding its predetermined maximum allowable stress.

The present apparatus includes a hollow cylinder having a slideable piston disposed therein which serves to divide it into two separate chambers. A piston rod is attached to the underside of the piston and extends through and forms a seal with an opening in one of the end walls of the cylinder. A bypass conduit connects the two cylinder chambers. Positioned in the conduit is a means for controlling the flow of fluid between the chambers. When pressure on the underside of the piston reaches a preset level, the flow control means opens to permit a sufficient flow of fluid through the conduit to maintain the pressure on the piston at or below the pressure level corresponding to the maximum allowable stress in the suspended member or the apparatus to which it is connected. The apparatus of the invention is adapted to permit one end to be connected to the drill rig hoisting means and the other to the member to be suspended. Preferably, a return conduit also extends between the two cylinder chambers. The return conduit serves to conduct fluid back to the rod side of the piston, permitting the apparatus to be reset. Means are provided in the return conduit for permitting flow of fluid to the rod side of the piston from the other side during the reset operation, while preventing fluid flow in the opposite direction during normal operation of the stress limiting device. Preferably, the means provided for this purpose is a check valve.

In operation, the stress limiting device of the invention is integrated into the suspended member between the hoisting apparatus and the bottom load. When the hoist pulls upward, it increases the tensile stress in the suspended member and the apparatus of the invention. This in turn causes a proportionate increase in the pressure of the fluid contained in the chamber on the underside or rod side of the piston. When the pressure in the chamber reaches a preset limit, the control means in the conduit opens, allowing the fluid to flow from one side of the piston to the other, permitting the piston to slide relative to the cylinder. In this fashion, the apparatus of the invention keeps the tension in the suspended member from exceeding its predetermined maximum allowable stress. As a result, neither the apparatus on the sea floor nor the suspended member will become overstressed to the point where it will yield or fail.

The present invention will thus be seen to provide a practical system for limiting tension in pipe strings or other members suspended from a floating vessel by preventing the tensile stress from exceeding a predetermined maximum allowable level. The apparatus of the present invention therefore offers significant advantages for operations where suspended members, or apparatus attached thereto, may be subjected to stresses that may cause them to yield or fail.

DESCRIPTION OF THE PREFERRED EMBODIMENTS

Figure 1:
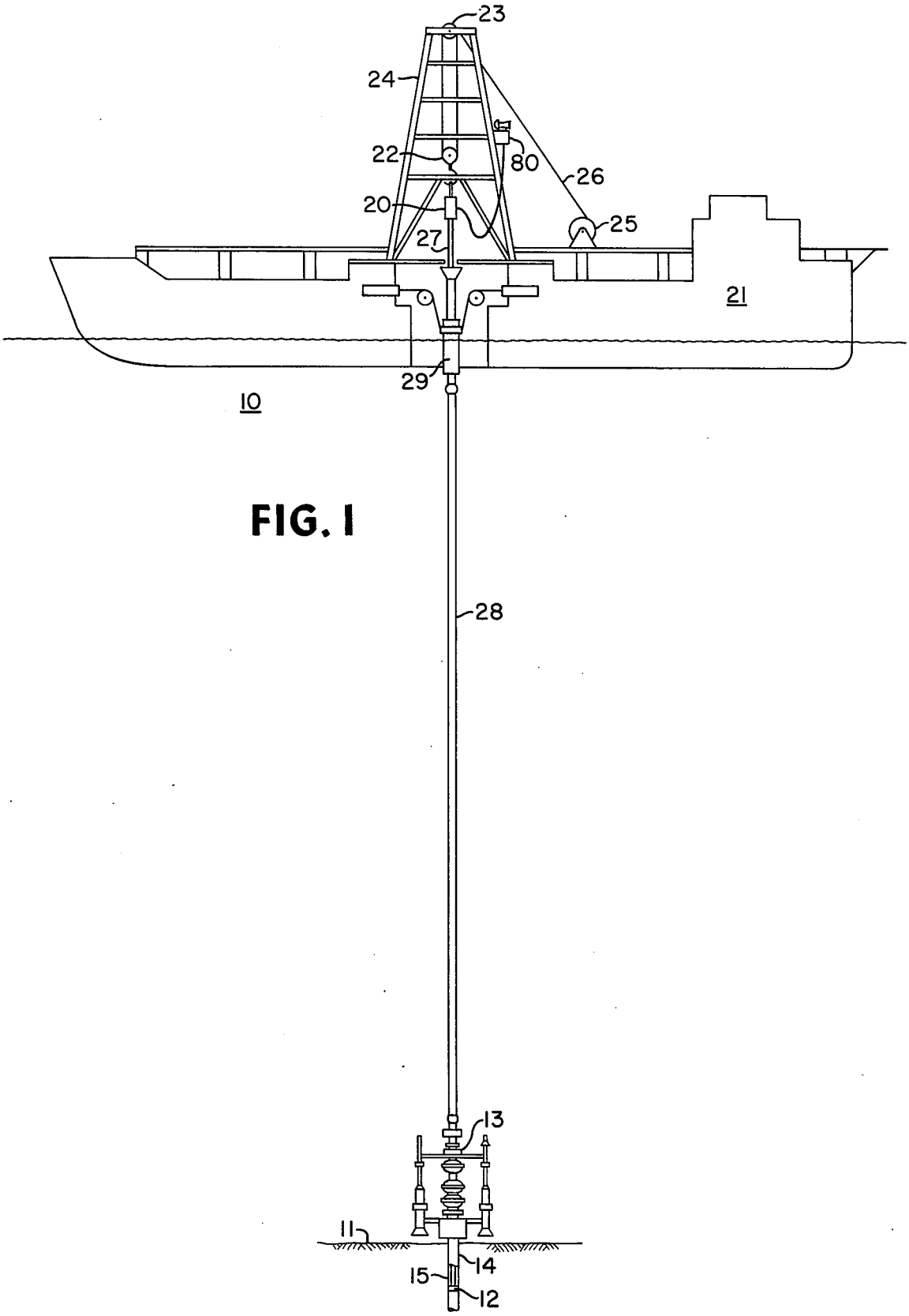
FIG. 1 is a schematic elevation view, partially in section, of a drilling vessel floating on a body of water and provided with apparatus embodying the present invention.
Figure 3:
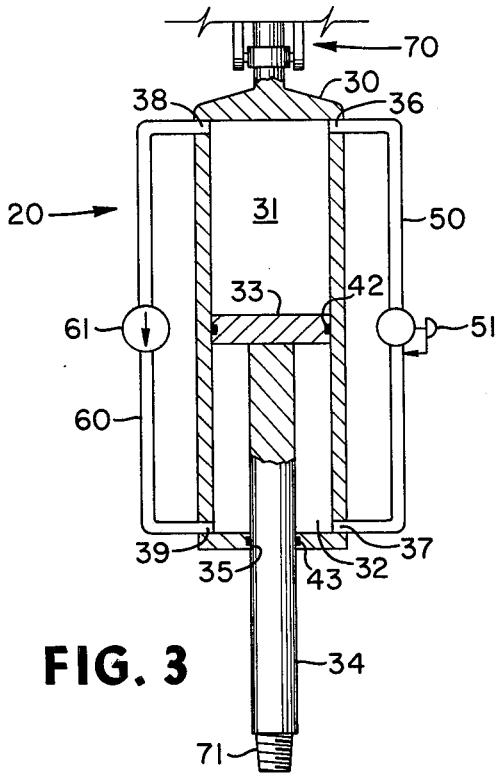
FIG. 3 is a cross-sectional view of another embodiment of this invention.
Figure 2:
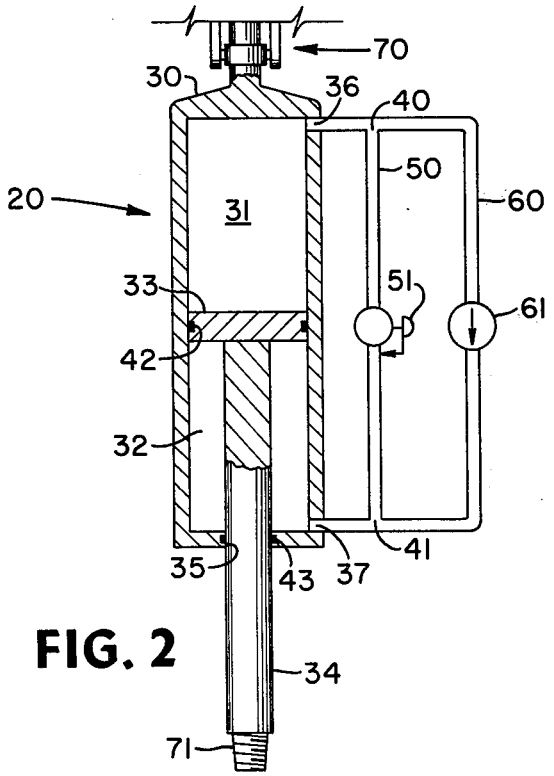
FIG. 2 is a cross-sectional view of the preferred embodiment of this invention.

FIG. 1 depicts a typical offshore drilling vessel 21 and a possible relative location of the apparatus of the present invention. The vessel 21 will be understood to include the normal complement of equipment used in offshore drilling operations, although only a part of this apparatus is shown. Drilling vessel 21 is shown floating on a body of water 10. The stress limiting apparatus of the present invention is identified by numeral 20 and is depicted as suspended directly from the traveling block 22. Traveling block 22 is in turn suspended from crown block 23 situated atop drilling derrick 24. The draw works 25 is connected to the traveling block by hoisting cable 26 which extends over crown block 23. The draw that either bypass conduit 50 or return conduit 60, alternatively, could be independently contained within piston 33.

Although not shown in the drawings, as least one sealable filler port must be provided somewhere in the cylinder or conduit walls to permit the apparatus to be filled with fluid. An incompressible fluid, preferably a hydraulic fluid, should be utilized. In addition, it is preferable that bypass conduit 50 and return conduit 60, when located external to cylinder 30, be enclosed by protective caging to prevent accidental damage during handling. As an alternative to protective caging, the conduits could form an integral part of the cylinder wall.

At the beginning of normal operations, it is desirable to have piston 33 positioned within cylinder 30 such that chamber 31 above the piston is of minimal volume and chamber 32 beneath the piston is of a maximum volume. This orientation allows the maximum stroke of piston 33. As the hoisting means lifts upward, the apparatus of the present invention 20 and the suspended member, drill string 27 as illustrated, are subjected to increasing axial stresses. As long as the axial tensile stress in drill string 27 is less than the predetermined maximum allowable stress, no fluid will be allowed to flow between the two chambers. Therefore, the apparatus of this invention 20 will perform as a rigid segment of drill string 27.

When the tensile stress in drill string 27 reaches the predetermined maximum allowable level, back pressure regulator 51 will open to allow fluid to flow through bypass conduit 50 extending between chamber 32 and chamber 31. Control means 51 regulates the rate of flow as required to allow the fluid to flow at such a rate that the stress in drill string 27 will not exceed the predetermined maximum allowable stress. It will be clear that this fluid flow will cause the stress limiting apparatus of the present invention 20 to elongate, preventing the stress in drill string 27 from exceeding the predetermined maximum allowable stress. The desired maximum allowable stress in the suspended member is set by setting back pressure regulator 51 to open when the fluid pressure in chamber 32 reaches a maximum allowable pressure corresponding to that stress level.

Preferably, a warning alarm system, shown as number 80 in the drawings, is incorporated into the apparatus of the present invention 20 to signal when the maximum allowable stress in the suspended member is attained. The alarm may be actuated by a limit switch which senses the motion of piston 33 or piston rod 34 relative to cylinder 30 or by a pressure switch actuated by the pressure in chamber 32. Alternatively, it could be actuated by the opening of the back pressure regulator 51 or by direct measurement of the stress in the suspended member.

When it is desired to reset the apparatus of the present invention 20 to minimize the volume of chamber 31 and maximize the volume of chamber 32, it normally is necessary to place an axial compressive stress across the apparatus 20; however, the amount of force will be minimal since the slightest compressive pressure will open check valve 61, allowing fluid to flow through return conduit 60 from one side of the piston to the other. It should be noted that a pump could be placed in the return conduit to pump fluid from one chamber to the other when it is desired to reset the apparatus. This arrangement would eliminate the necessity of axially compressing the device.

I claim:

1. In a floating drilling system including a floating drilling vessel having a drilling derrick, a crown block disposed within the derrick, a traveling block which is suspended below the crown block by a hoisting cable which extends through the traveling block and over the crown block, and a string of drill pipe which is suspended by and below the traveling block, an improved apparatus for limiting tension in the drill pipe which is interconnected between the traveling block and the drill pipe which comprises:

a. a cylinder closed at one end and having an opening at the other end;

b. a piston disposed within said cylinder, slideable therewithin and forming a slideable seal with the inner wall thereof;

c. a piston rod connected to said piston, extending through said opening in the end of said cylinder and forming a slideable seal with the wall of said cylinder at said opening;

d. a bypass conduit extending from one side of the piston to the other;

e. a return conduit extending from one side of the piston to the other and a means in said return conduit for permitting flow therethrough to the rod side of the piston from the other side and preventing fluid flow in the opposite direction;

f. means in said bypass conduit for controlling the flow of a fluid therethrough from the rod side of said piston to the other, said means adapted to actuate when pressure on the rod side of the piston reaches a predetermined level to permit sufficient fluid to flow through the said conduit to maintain such pressure at the predetermined level, said means otherwise preventing flow therethrough when said pressure is below said predetermined level; and g. means for connecting said piston rod and said cylinder to the drill pipe and the traveling block.

2. The improved apparatus of claim 1 wherein said bypass conduit is positioned externally of said cylinder and extends from a port through the wall of said cylinder adjacent one end to a port through the wall of said cylinder adjacent the opposite end.

3. The improved apparatus of claim 1 wherein said means for controlling the fluid flow is a backpressure regulator.

4. The improved apparatus of claim 1 wherein the return conduit is positioned externally of said cylinder and extends from a port through the wall of said cylinder adjacent one end to a port through the wall of said cylinder adjacent the opposite end.

5. The improved apparatus of claim 1 wherein said return conduit is connected to the said bypass conduit at two points and forms a loop around the said means for controlling fluid flow through said bypass conduit so as to provide a path for fluid flow therearound.

6. The improved apparatus of claim 1 wherein said means for permitting the flow through said return conduit is a check valve.

* * * * *

UNITED STATES PATENT OFFICE

CERTIFICATE OF CORRECTION

PATENT NO. : 4,049,239

DATED : September 20, 1977

INVENTOR(S) : James D. Howell

It is certified that error appears in the above-identified patent and that said Letters Patent are hereby corrected as shown below:

Delete: [54] DRILL SPRING TENSION LIMITING DEVICE FOR FLOATING DRILLING VESSELS and insert: [54] DRILL STRING TENSION LIMITING DEVICE FOR FLOATING DRILLING VESSELS Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*